US011413874B2

(12) United States Patent
Osborne et al.

(10) Patent No.: US 11,413,874 B2
(45) Date of Patent: Aug. 16, 2022

(54) EXTRACTION RESERVOIR-TRIGGERED FLUID EXTRACTION

(71) Applicant: Hewlett-Packard Development Company, L.P., Spring, TX (US)

(72) Inventors: Paul Allan Osborne, Vancouver, WA (US); Devin Michael Knowles, Vancouver, WA (US); Christopher John Arnold, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/276,950

(22) PCT Filed: Dec. 4, 2018

(86) PCT No.: PCT/US2018/063885
§ 371 (c)(1),
(2) Date: Mar. 17, 2021

(87) PCT Pub. No.: WO2020/117214
PCT Pub. Date: Jun. 11, 2020

(65) Prior Publication Data
US 2022/0032634 A1 Feb. 3, 2022

(51) Int. Cl.
*B41J 2/175* (2006.01)
*B41J 2/18* (2006.01)

(52) U.S. Cl.
CPC ..... *B41J 2/17523* (2013.01); *B41J 2/17596* (2013.01); *B41J 2/18* (2013.01)

(58) Field of Classification Search
CPC . B41J 2/175; B41J 2/17523; B41J 2/18; B41J 2/17596; B41J 2/17
See application file for complete search history.

(56) References Cited

U.S. PATENT DOCUMENTS 4,910,529 A 3/1990 Regnault
4,967,207 A 10/1990 Ruder
6,224,198 B1 5/2001 Cook et al.
6,454,381 B1 * 9/2002 Olsen ..... B41J 2/17566 347/7
6,652,080 B2 11/2003 Childs et al.
(Continued)

FOREIGN PATENT DOCUMENTS

EP 1105297 B1 5/2003
EP 1359026 A1 11/2003
(Continued)

*Primary Examiner* — An H Do
(74) *Attorney, Agent, or Firm* — HP Inc. Patent Department

(57) ABSTRACT

In one example in accordance with the present disclosure, a fluid extraction system is described. The fluid extraction system includes an interface to fluidically and electrically couple a removable extraction reservoir to a printing device. A return line of the fluid extraction system is to connect the interface and a reservoir of the printing device. The fluid extraction system includes a switch to 1) responsive to attachment of the removable extraction reservoir to the printing device, open the return line to direct fluid form the reservoir to the interface and 2) responsive to removal of the removable extraction reservoir from the printing device, close the return line.

15 Claims, 9 Drawing Sheets

(56) References Cited

U.S. PATENT DOCUMENTS

| | | | | |
|---|---|---|---|---|
| 6,789,883 | B2 * | 9/2004 | Heim | B41J 2/1752 347/85 |
| 6,945,640 | B2 * | 9/2005 | Cheok | B41J 2/17506 347/85 |
| 7,556,367 | B2 | 7/2009 | Langford et al. | |
| 8,033,657 | B2 * | 10/2011 | Sasaki | B41J 2/175 347/85 |
| 8,057,006 | B2 * | 11/2011 | Rice | B41J 2/17546 347/14 |
| 8,403,466 | B1 | 3/2013 | Turgeman | |
| 8,851,644 | B2 | 10/2014 | Shirono et al. | |
| 8,939,558 | B2 | 1/2015 | Katoh et al. | |
| 9,434,171 | B2 | 9/2016 | Yamada et al. | |
| 9,701,129 | B2 | 7/2017 | Pourtier et al. | |
| 2006/0092243 | A1 | 5/2006 | Langford et al. | |
| 2015/0085003 | A1 | 3/2015 | Ito | |
| 2018/0215162 | A1 | 8/2018 | Benson et al. | |
| 2021/0362505 | A1 | 11/2021 | Arnold et al. | |

FOREIGN PATENT DOCUMENTS

| | | | |
|---|---|---|---|
| EP | 1080908 | B1 | 12/2005 |
| EP | 2576227 | A1 | 4/2013 |
| JP | 2003034038 | A | 2/2003 |
| JP | 2007313785 | A | 12/2007 |
| JP | 2011056830 | A | 3/2011 |
| JP | 4957852 | B2 | 6/2012 |
| WO | 2013/015788 | A1 | 1/2013 |
| WO | WO-2017019101 | A1 | 2/2017 |

* cited by examiner

EXTRACTION RESERVOIR-TRIGGERED FLUID EXTRACTION

BACKGROUND

Printing devices operate to dispense a fluid onto a substrate surface. For example, a printer may operate to dispense fluid such as ink onto a surface such as paper in a predetermined pattern. In another example, an additive manufacturing fluid is dispensed as part of an additive manufacturing operation. The fluid is supplied to such printing devices from a reservoir or other supply. That is, a reservoir holds a volume of fluid that is passed to the printing device and ultimately deposited on a surface.

BRIEF DESCRIPTION OF THE DRAWINGS

The accompanying drawings illustrate various examples of the principles described herein and are part of the specification. The illustrated examples are provided for illustration, and do not limit the scope of the claims.

Figure 1:
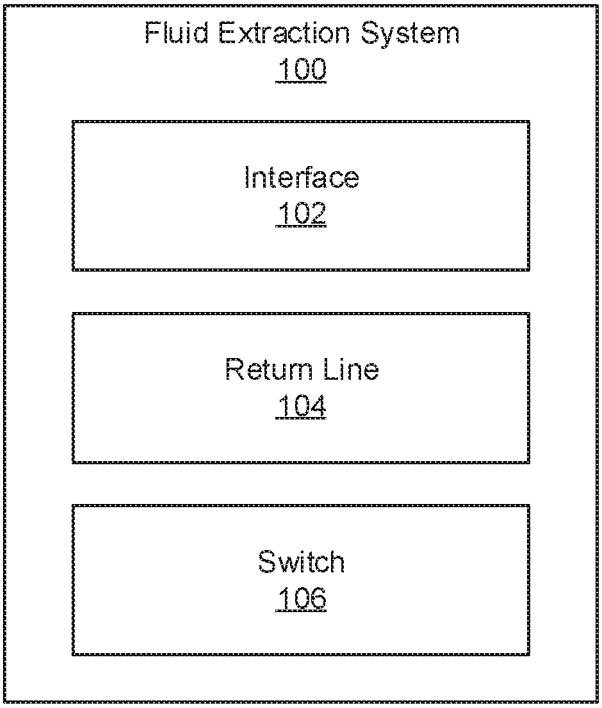
FIG. 1 is a block diagram of a fluid extraction system for extraction reservoir-triggered fluid extraction, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Fluid such as ink in a printer or additive manufacturing liquid in a 3D printer, is deposited on a surface from a printing device. Fluid is supplied via a reservoir that holds the fluid to be ejected. In some examples, e.g., a continuous fluid system, a reservoir is internal to the printer. Over time as the fluid is depleted from the reservoir it may be refilled or topped off.

While such printers with continuous fluid systems may be beneficial, certain situations could benefit from additional operation. In some cases, for example, printing devices with continuous fluid systems may be used under a contract in which the print fluid, such as ink, is supplied under terms of the contract. However, if a printing device reaches an end of contract date with fluid still remaining in the reservoir, a fluid supplier may wish to extract the fluid from the reservoir. For example, in cases in which the printing device is to be returned to the supplier at the end of the contract, the fluid supplier may have an interest in extracting fluid from the reservoir prior to the printing device being returned to the printing device supplier, such as to avoid potential fluid spills during transport. In cases in which the device has been purchased by the end user, the fluid supplier may have an interest in extracting fluid from the reservoir at the end of the contract, such as to avoid having the end user use contractual fluid without payment and/or while not under contract. In another example, the printing device may have a malfunction which is too costly to repair such that the printing device is to be removed from operation. In this example the fluid supplier again may wish to extract the fluid from the reservoir prior to disposal of the printing device.

Other examples of when it may be desirable to remove fluid such as ink from a reservoir include long term storage of the printing device and/or transportation of the printing device. In either scenario, leaving the ink in the reservoir may be undesirable as pigments may settle and cause blockage in a delivery system, the ink may dry out during long term storage, and/or the ink may spill during the jostling that generally accompanies transportation.

As yet another example, it may be desirable to remove ink from a reservoir during a service, repair, and/or replacement event of that particular reservoir, another reservoir, or a module in which the reservoirs are disposed.

Accordingly, the present specification describes a fluid extraction operation wherein fluid in a reservoir can be extracted in a secure fashion while maintaining the integrity of the fluid disposed therein. That is, the fluid is not exposed to environmental contamination and can be recycled for use in other printing devices.

While such a fluid extraction operation results in the efficient management of fluid supplies, some characteristics may complicate the fluid extraction process. For example, during an extraction operation, fluid is pulled from a reservoir through a return line to a removable extraction reservoir. Following extraction, after the removable extraction reservoir has been removed, pressure differentials and other environmental conditions may cause an amount of fluid to continue to be drawn from the reservoir, even though the extraction reservoir is not in place. Accordingly, fluid may flow through the return line, but instead of being deposited in the extraction reservoir, this fluid may spill out over the printing device and/or the user.

In another example, a user may remove the extraction reservoir before the extraction operation is complete. That is, the user may remove the extraction reservoir before the pump stops running. This similarly may result in spillage on the printing device and/or the user. Other sources of leakage may also be present.

Accordingly, the present specification describes a fluid extraction system that prevents leakage. Specifically, the present specification describes a system that includes a switch in the interface where the removable extraction reservoir is received in the printing device. The switch is toggled upon the insertion and removal of the removable extraction reservoir. Specifically, when engaged, i.e., when a removable extraction reservoir is in place, the switch is in a first position. While in this position, fluid is extracted from the reservoir via a return line running form the reservoir to the removable extraction reservoir. In this example, the switch triggers opening of a return line valve such that fluid can flow through the return line to the removable extraction reservoir. When the removable extraction reservoir is removed, the switch changes position. This change in position triggers a closing of the return line valve such that no more fluid can pass through the return line to the interface. Thus, the present specification prevents the spillage of fluid when a removable extraction reservoir is not in place.

Specifically, the present specification describes a fluid extraction system. The system includes an interface to fluidically and electrically couple a removable extraction reservoir to a printing device. A return line of the fluid extraction system connects the interface and a reservoir of the printing device. A switch of the fluid extraction system, responsive to attachment of the removable extraction reservoir to the printing device, opens the return line to direct fluid form the reservoir to the interface. The switch, responsive to removal of the removable extraction reservoir from the printing device, closes the return line.

The present specification also describes a fluid transport system. The fluid transport system includes a reservoir to hold an amount of fluid, an interface to fluidically couple a removable extraction reservoir to a printing device, and supply line to connect the interface and the reservoir. A fill pump draws fluid to the reservoir. A return line connects the reservoir and the supply line. The return line is coupled to the supply line between the interface and fill pump. A return line valve is disposed along the return line to open and close the return line. A switch of the fluid transport system 1) responsive to attachment of the removable extraction reservoir to the printing device, opens the return line valve to direct fluid from the reservoir to the removable extraction reservoir and 2) responsive to removal of the removable extraction reservoir from the printing device, closes the return line valve. The fluid transport system also includes a recirculation pump to, during an extraction operation, move fluid from the reservoir to the interface.

The present specification also describes a method. According to the method, a removable extraction reservoir is received at an interface of a printing device. Responsive to attachment of the removable extraction reservoir, a return line valve is opened to fluidically couple a return line to the removable extraction reservoir. Fluid is then extracted from the reservoir to the removable extraction reservoir.

Such a fluid extraction system may 1) prevent disposal of otherwise usable fluid disposed within an out-of-contract/non-functioning printing device; 2) reduce financial exposure for fluid suppliers as they can reclaim fluid dispensed in an out-of-contract/non-functioning printing device; 3) prevent printing device failure due to ink drying out during long term storage; 4) reduce service cost and complexity; 5) prevent re-fill with unauthorized fluid; 6) allow printing device recyclability without fluid in reservoir; 7) enable extraction from a single reservoir; 8) enable secure reclamation and refilling of ink; and 9) prevents fluid spillage during/after fluid extraction due to removal of a removable extraction reservoir.

Figure 2:
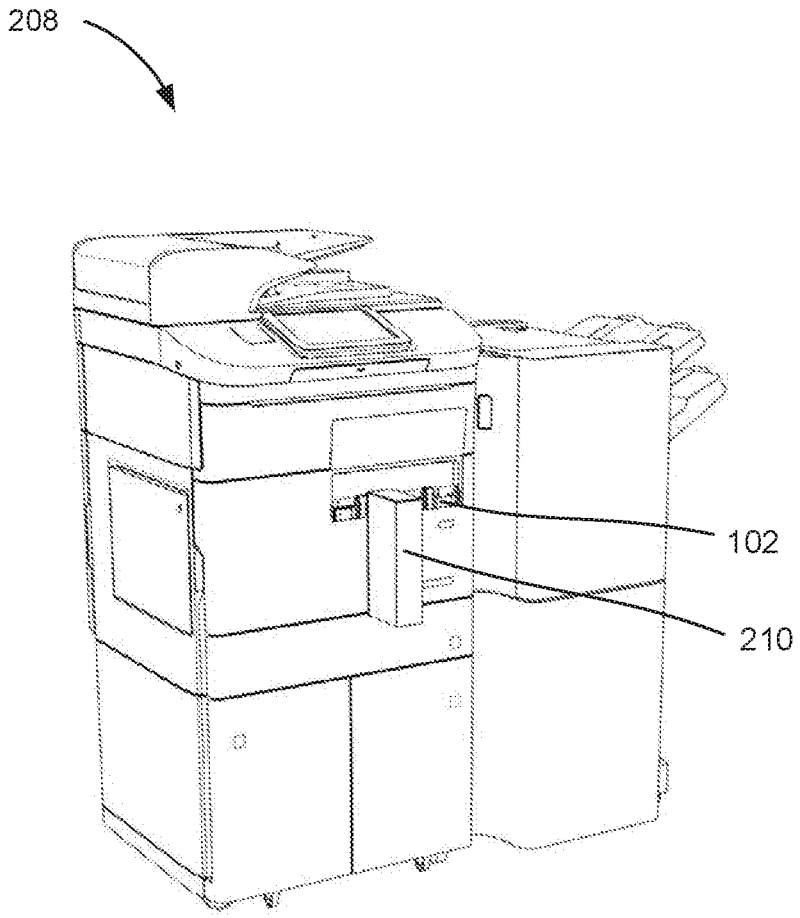
FIG. 2 is an isometric view of a printing device with extraction reservoir-triggered fluid extraction, according to an example of the principles described herein.

Turning now to the figures, FIG. 1 is a block diagram of a fluid extraction system (100) for extraction reservoir-triggered fluid extraction, according to an example of the principles described herein. Specifically, FIG. 1 is a block diagram of a closed-loop fluid extraction system (100) which extracts fluid, such as ink, in a manner that preserves fluid integrity so that it may be used to fill the same, or different, printers in the future. The fluid extraction system (100) may be disposed in a printing device as depicted in FIG. 2. In this example, the fluid that is extracted is ink. In other examples, the fluid that is extracted may be other than ink. For example, the fluid may be a fusing agent used in an additive manufacturing operation.

The fluid extraction system (100) includes an interface (102). The interface (102) receives a removable extraction reservoir and fluidically and electrically couples the removable extraction reservoir to a printing device in which the fluid extraction system (100) is disposed. That is, the interface (102) may have a needle that pierces a septum of the removable extraction reservoir to allow fluid to flow between the removable extraction reservoir and the internal reservoir of the printing device. Other types of fluid interfaces may also be used, other than a needle that pierces a septum.

The interface (102) may also have an electrical connection that mates with an electrical connection of the removable extraction reservoir. Via the mating of these two electrical connections, a data transmission path is established. The data transmission path facilitates the transmission of various pieces of data. For example, a memory device on the removable extraction reservoir may indicate characteristics of the removable extraction reservoir and/or characteristics of the fluid contained therein. This information may be used during a refill and/or extraction process. For example, the information may indicate whether the reservoir is an extraction reservoir that is empty or a refill reservoir that is full. That is, an extraction reservoir may be empty and may be intended to receive fluid from the reservoir during an extraction operation. By comparison, a refill reservoir may be full and may be intended to deliver fluid to the reservoir. Accordingly, this information may gate what operation, i.e., a refill or extraction, is carried out.

Other examples of information include a capacity of the removable extraction reservoir. Accordingly, a fluid extraction process may be terminated when a quantity of fluid extracted matches the capacity of the removable extraction reservoir. Further, the data may include an amount of fluid already disposed in the removable extraction reservoir. Again, this may be used to terminate fluidic extraction when the capacity less the amount of fluid disposed in the extraction reservoir is reached. In another example, the amount of fluid disposed within the removable extraction reservoir may be used during a re-fill operation wherein fluid is passed from the extraction reservoir to an internal reservoir of the printing device. Accordingly, the refill operation may be terminated when the quantity of fluid passed to the reservoir from the extraction reservoir reaches the amount of fluid disposed in the extraction reservoir.

As yet another example, the data may indicate a type of fluid, for example a type of ink. The type of ink or the type of fluid may affect various parameters of the extraction operation such as whether extraction is permissible, an extraction rate, and/or an extraction amount. Other parameters may also be affected.

While particular reference is made to a few pieces of data that are included in the memory device, that are transferred through the interface (102), and that control fluidic extraction, other pieces of data may also be transferred and used.

The fluid extraction system (100) also includes a return line (104). The return line (104) is the path by which fluid is removed from the reservoir to the replaceable extraction reservoir during an extraction operation. For example, the return line (104) is connected to the reservoir and to the interface (102) where the removable extraction reservoir is to be attached. Upon initialization of the extraction operation, fluid is pulled from the reservoir, through the return line (104) and from there into the removable extraction reservoir.

The fluid extraction system (100) also includes a switch (106). The switch (106) operates to obstruct the fluid path between the reservoir and the removable extraction reservoir. The fluid path may be obstructed when it is desired that fluid not flow towards the removable extraction reservoir. For example, a user may remove the removable extraction reservoir prior to completion, or at the completion, of an extraction operation, but before the recirculation pump which drives the fluid through the return line (104) has shut off. If the recirculation pump is active while the removable extraction reservoir is not attached, fluid may spill out into the printing device and/or over the user. Consequently, in this scenario it may be desirable to close off the return line (104) such that fluid does not flow towards the interface (102).

Accordingly, the switch (106) is a component that responsive to an attachment of the removable extraction reservoir, may trigger an opening of the return line (104) to direct fluid from the reservoir to the removable extraction reservoir. Responsive to a removal of the removable extraction reservoir, the switch (106) may trigger a closing of the return line (104).

In some examples, the switch (106) may be a mechanical device. For example, insertion of the removable extraction reservoir may physically alter the position of a mechanical switch (106). A sensor can detect what position the switch (106) is in and may open the return line valve. By comparison, removal of the removable extraction reservoir returns the mechanical switch (106) to another position. The sensor can detect when the switch (106) is in this position and may close the return line valve, thus preventing fluid from passing through the return line (104) to the removable extraction reservoir. In another example, the switch (FIG. 1, 106) may be an electronic component. That is, the switch (FIG. 1, 106) may be sensor, such as an optical sensor to detect when a removable extraction reservoir is in place.

As described above, the switch (106) may be located in the interface (102) where the removable extraction reservoir is to be received. In this fashion, the switch (106) may be acted upon by insertion of the removable extraction reservoir into the interface (102).

Thus, the present fluid extraction system (100) relies on a switch (106) to determine when and when not to open a return line. Doing so ensures that when a removable extraction reservoir is not in the interface (102), no fluid can be passed to the interface (102). Thus, leakage out the return line (104) at the interface (102) is prevented.

FIG. 2 is an isometric view of a printing device (208) with extraction reservoir-triggered fluid extraction, according to an example of the principles described herein. In this example, the fluid extraction system (FIG. 1, 100) includes the removable extraction reservoir (210) to which the fluid is extracted. As described above, the removable extraction reservoir (210) has a corresponding interface that mates with the interface (102) of the fluid extraction system (FIG. 1, 100) such that fluid can be transferred between the printing device (208) and the removable extraction reservoir (210).

The removable extraction reservoir (210) refers to a device that holds fluid. The fluid may be any type including ink for 2D printing and/or an additive manufacturing fabrication agent. The removable extraction reservoir (210) may take many forms. For example, the removable extraction reservoir (210) may include a pliable reservoir that conforms to the contents disposed therein. Because a pliable reservoir is difficult to handle and manipulate, it may be disposed in a rigid container, for example a corrugated fiberboard carton.

The removable extraction reservoir (210) may include channels and openings to facilitate the extraction of the fluid from, and in some examples delivery of fluid to, the printing device (208). In some examples, the opening to the removable extraction reservoir (210) may have a port or closing such that when the removable extraction reservoir (210) is not disposed in a printing device (208), the fluid therein does not leak out.

The removable extraction reservoir (210) also includes an electrical connection to establish a data transmission path between the removable extraction reservoir (210) and the printing device (208).

As described above, the interface (102) mates with an interface on the removable extraction reservoir (210). For example, the interface (102) may include a needle to be inserted into a removable extraction reservoir (210). The needle may be hollow and allow fluid to pass there through. The needle may pierce a septum on the removable extraction reservoir (210) and be put in fluidic communication with contents of the removable extraction reservoir (210). In another example, a valve or gasket may be present on the removable extraction reservoir (210) and the needle may pass through the valve or gasket.

Upon insertion, a component of the removable extraction reservoir (210) operates against the switch (FIG. 1, 106). For example, protrusions on the removable extraction reservoir (210), if they match keyed slots, press against the switch (FIG. 1, 106) to toggle the opening and closing of the return line valve.

In some examples, the printing device (208) may include multiple interfaces (102), with each interface (102) being uniquely keyed to a removable extraction reservoir (210) with different characteristics, such as different colors. For simplicity of illustration, a single removable extraction reservoir (210) is depicted as being coupled to the printing device (208). However, the fluidic extraction system (FIG. 1, 100) may be able to extract fluid from multiple internal reservoirs to multiple removable extraction reservoirs (210).

Figure 3A:
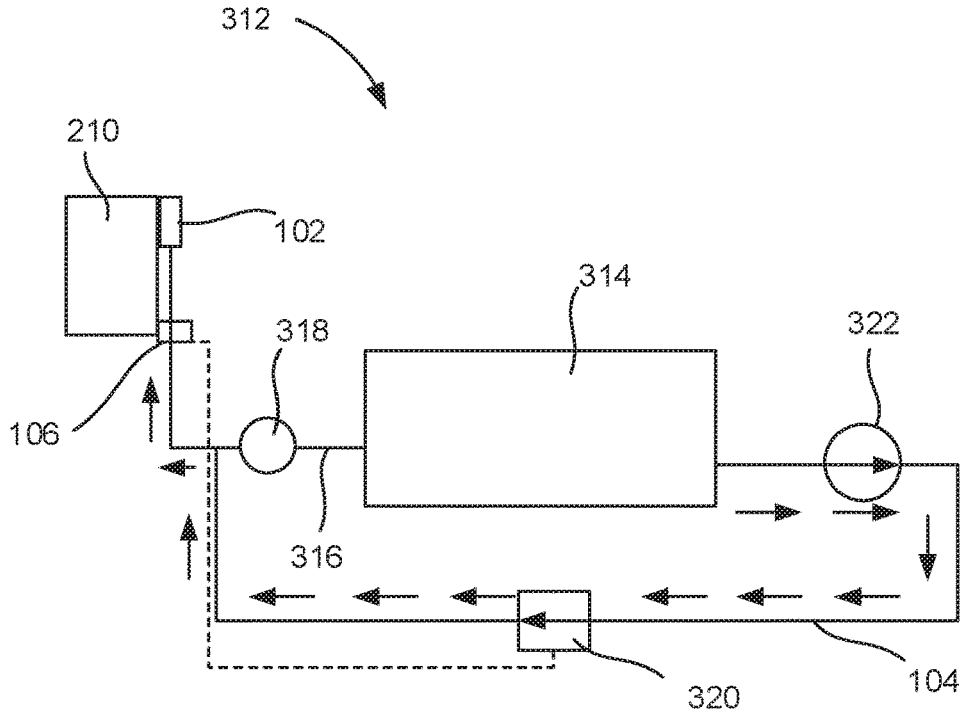
FIGS. 3A and 3B are diagrams of a fluid transport system for extraction reservoir-triggered fluid extraction, according to an example of the principles described herein.
Figure 3B:
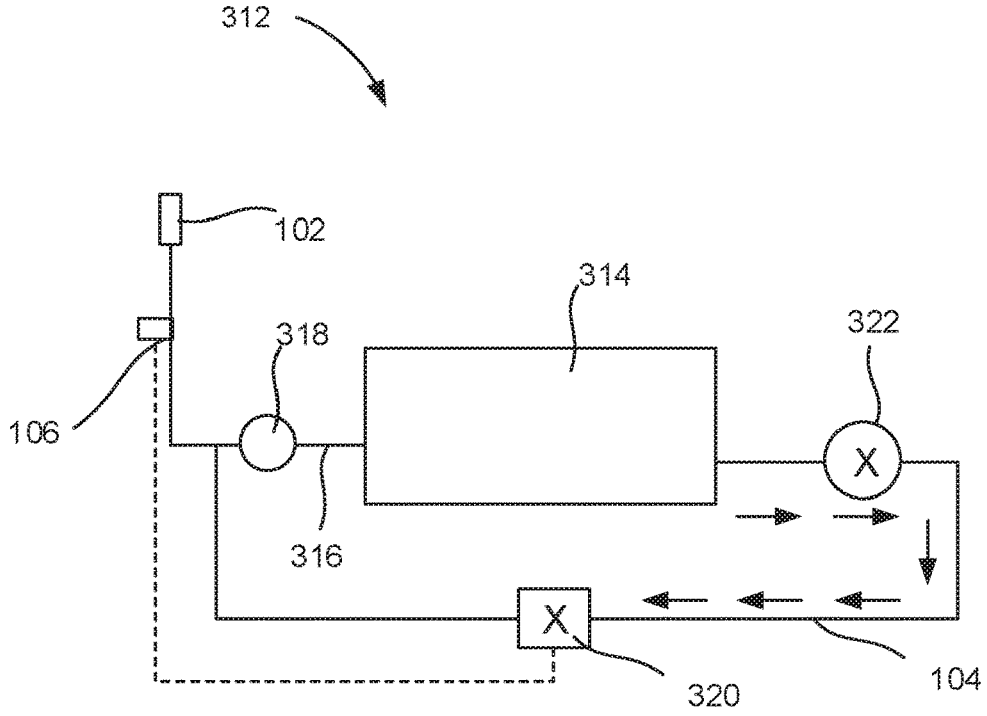

FIGS. 3A and 3B are diagrams of a fluid transport system (312) for extraction reservoir-triggered fluid extraction, according to an example of the principles described herein. Specifically, FIG. 3A is a diagram of the fluid transport system (312) during fluid extraction and FIG. 3B is a diagram of the fluid transport system (312) following fluid extraction when the removable extraction reservoir (210) has been removed.

The fluid transport system (312) includes a reservoir (314). As described above, the reservoir (314) may be internal to a printing device (FIG. 2, 208) and may hold different types of fluid. For example, the reservoir (314) may hold an ink used in 2D printing. In another example, the reservoir (314) holds a fusing agent in a 3D printing process. In some examples, a printing device (FIG. 2, 208) may have multiple reservoirs (314). Accordingly, each reservoir (314) may correspond to a different fluid transport system (312).

The fluid transport system (312) also includes the fluid extraction system (FIG. 1, 100). As described above, the fluid extraction system (FIG. 1, 100) includes an interface (102) as described above to receive a removable extraction reservoir (210). The interface (102) may include components such as a needle to be inserted into the removable extraction reservoir (210) to facilitate fluid transport and electrical connections to facilitate data transmission. In some examples, the interface (102) includes keying features to gate insertion of a particular type of removable fluid reservoir (210).

FIGS. 3A and 3B also depict the supply line (316) through which fluid is supplied to the reservoir (314). That is, in addition to receiving fluid from the reservoir (314), the removable extraction reservoir (210), or another refill reservoir, may be placed at the interface (102) to refill the reservoir (314). In other words, the supply line (316) connects the interface (102) to the reservoir (314) and delivers fluid to the reservoir (314) from the removable extraction reservoir (210) during a refill operation. However, during a fluid extraction operation, fluid may flow through a portion of the supply line (316) in the reverse direction towards the removable extraction reservoir (210).

The fluid transport system (312) also includes a fill pump (318). This fill pump (318) draws fluid from the removable extraction reservoir (210) to the reservoir (314) through the supply line (316). As depicted in FIGS. 3A and 3B, the return line (104) is coupled to the supply line (316) between the interface (102) and the fill pump (318).

FIGS. 3A and 3B also clearly depict the return line (104) that connects the reservoir (314) to the supply line (316) and that transports fluid from the reservoir (314) to the removable extraction reservoir (210). In some examples, the return line (104) is coupled at one end to the reservoir (314) and at the other end to the supply line (316). Thus, during extraction, fluid flows from the reservoir (314) through the return line (104) and eventually to the supply line (316).

FIGS. 3A and 3B also depict components found on the return line (104) that operate to open and close fluid flow through the return line (104). Specifically, the fluid extraction system (FIG. 1, 100) may include a return line valve (320) disposed along the return line (104). Upon attachment of the removable extraction reservoir (210), this return line valve (320) is opened such that fluid may flow from the reservoir (314) through the return line (104) to the removable extraction reservoir (210). Upon removal of the removable extraction reservoir (210), this return line valve (320) is closed such that fluid is prevented from flowing, and potentially spilling out of, the return line (104).

FIGS. 3A and 3B also depict a recirculation pump (322). In some examples, the recirculation pump (322) may be used to recirculate fluid through a printhead coupled to the reservoir (314). During an extraction operation this recirculation pump (322) may be used to direct fluid through the return line (104). Control over the operation of the recirculation pump (322) may be triggered by the switch (106) and in other examples may be controlled independently. For example, upon attachment of the removable extraction reservoir (210), the action of the switch (106) may trigger activation of the recirculation pump (322) to draw fluid through the return line (104). Upon removal of the removable extraction reservoir (210), the action of the switch (106) may trigger deactivation of the recirculation pump (322). However, in other examples, the toggling of the switch (106) may not alter activation/deactivation of the recirculation pump (322). In this example, the recirculation pump (322) is controlled by another mechanism.

As described above, the fluid extraction system (FIG. 1, 100) includes a switch (106) that may be acted upon by the insertion of the removable extraction reservoir (210). That is, the insertion of the removable extraction reservoir (210) may displace the switch (106). A sensor may detect the movement of the switch (106) and open the return line (104) accordingly. In some examples, the switch (106) directly opens/closes the return line (104). In this example, the displacement of the switch (106) may complete a circuit between a power source and the return line valve (320) such that upon insertion, the power source opens the return line valve (320) to facilitate fluid flow through the return line (104).

A description of the various states of the fluid extraction system (FIG. 1, 100) will now be presented. Specifically, in FIG. 3A, the removable extraction reservoir (210) is inserted into an interface (102) of the printing device (FIG. 2, 208). Accordingly, the switch (106) is engaged. This engagement triggers the opening of the return line valve (320). This engagement may also trigger the activation of the recirculation pump (322) or the recirculation pump (322) may be triggered by a different mechanism. With both of these components active, the fluid passes through the return line (104) to the removable extraction reservoir (210) by way of a portion of the supply line (316). Due to the effect of the fill pump (318) being off, and thereby closed, fluid does not re-flow towards the reservoir (314) but instead is entirely directed to the removable extraction reservoir (210).

FIG. 3B depicts the fluid transport system (312) in a state when the removable extraction reservoir (210) has been removed. Immediately upon removal, the switch (106) is disengaged. In this example, the return line valve (320) is immediately closed so that fluid does not flow regardless of the activation state of the recirculation pump (322).

In some examples, in addition to closing the return line valve (320), the disengagement of the switch (106) triggers a deactivation of the recirculation pump (322). However, in other examples, disengagement of the switch (106) may have no effect on a deactivation of the recirculation pump (322) which may be deactivated by another, and independent, operation. Thus, the present fluid transport system (312) with the fluid extraction system (FIG. 1, 100) disposed therein, provides a mechanism to extract fluid from a reservoir (314) all while preventing unintentional and undesirable spillage of the fluid.

Figure 4:
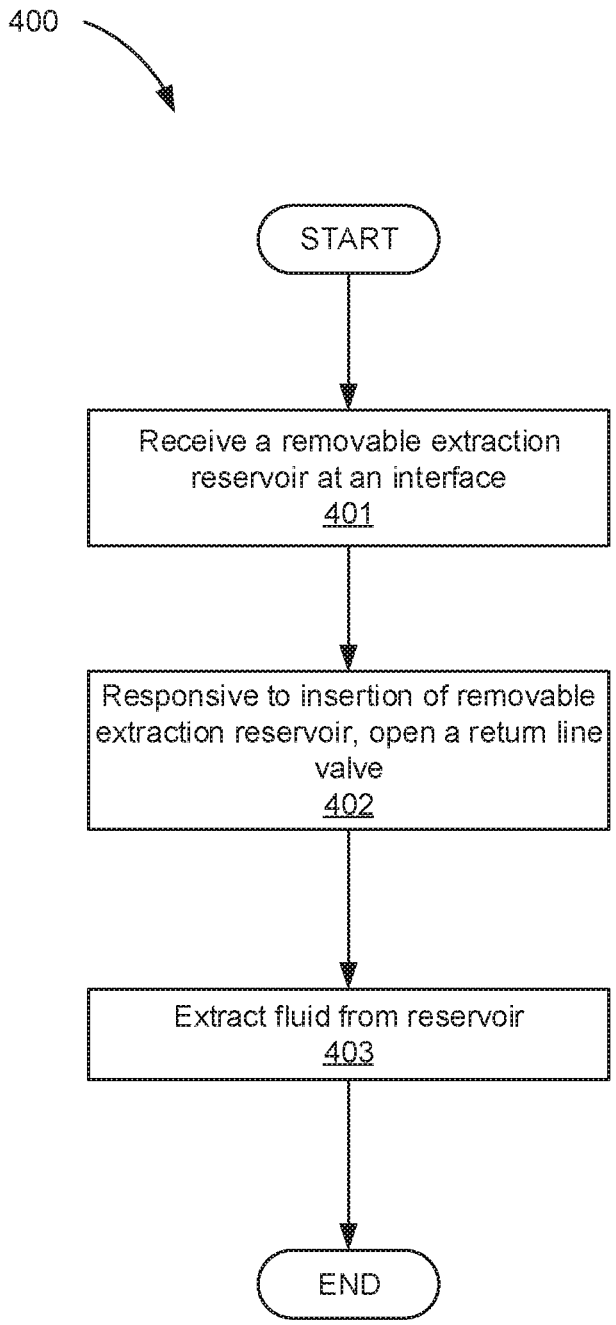
FIG. 4 is a flowchart of a method for extracting fluid to a removable extraction reservoir, according to an example of the principles described herein.

FIG. 4 is a flowchart of a method (400) for extraction reservoir-triggered fluid extraction, according to an example of the principles described herein. According to the method (400), a removable extraction reservoir (FIG. 2, 210) is received (block 401) at an interface (FIG. 1, 102). As described above, the interface (FIG. 1, 102) is a component of a fluid extraction system (FIG. 1, 100) that provides a mechanical, electrical, and fluidic connection between an inserted removable extraction reservoir (FIG. 2, 210) and a reservoir (FIG. 3, 314) of a printing device (FIG. 2, 208). That is, the interface (FIG. 1, 102) may mechanically retain the removable extraction reservoir (FIG. 2, 210) to the printing device (FIG. 2, 208) in which the fluid extraction system (FIG. 1, 100) is disposed. The interface (FIG. 1, 102) also includes electrical connections that mate with corresponding connections on the removable extraction reservoir (FIG. 2, 210) such that a data transmission path is established. The interface (FIG. 1, 102) also includes a needle or other component that pierces a septum or is otherwise inserted into the removable extraction reservoir (FIG. 2, 210). Through such a needle, fluid can be deposited into the removable extraction reservoir (FIG. 2, 210) or drawn from the removable extraction reservoir (FIG. 2, 208). A switch (FIG. 1, 106) is also disposed in the interface (FIG. 1, 102) such that upon reception/removal of a removable extraction reservoir (FIG. 2, 210) the switch (FIG. 1, 106) toggles the opening and closing of a return line valve (FIG. 3A, 320).

That is, responsive to attachment of the removable extraction reservoir (FIG. 2, 210), a return line valve (FIG. 3A, 320) is opened (block 402). The opening of the return line valve (FIG. 3A, 320) fluidically couples the reservoir (FIG. 3A, 314) to the removable extraction reservoir (FIG. 2, 210) through the return line (FIG. 1, 104). Accordingly, once a recirculation pump (FIG. 3A, 322) is activated, either by action of the switch (FIG. 1, 106) or not, fluid can pass from the reservoir (FIG. 3A, 314) to the removable extraction reservoir (FIG. 2, 210).

Fluid is then extracted (block 403) from the reservoir (FIG. 3A, 314) to the removable extraction reservoir (FIG. 2, 210). Such a method (400) thereby allows for the controlled and secure transportation of fluid from a printing device (FIG. 2, 208) to a removable extraction reservoir (FIG. 2, 210).

Figure 5A:
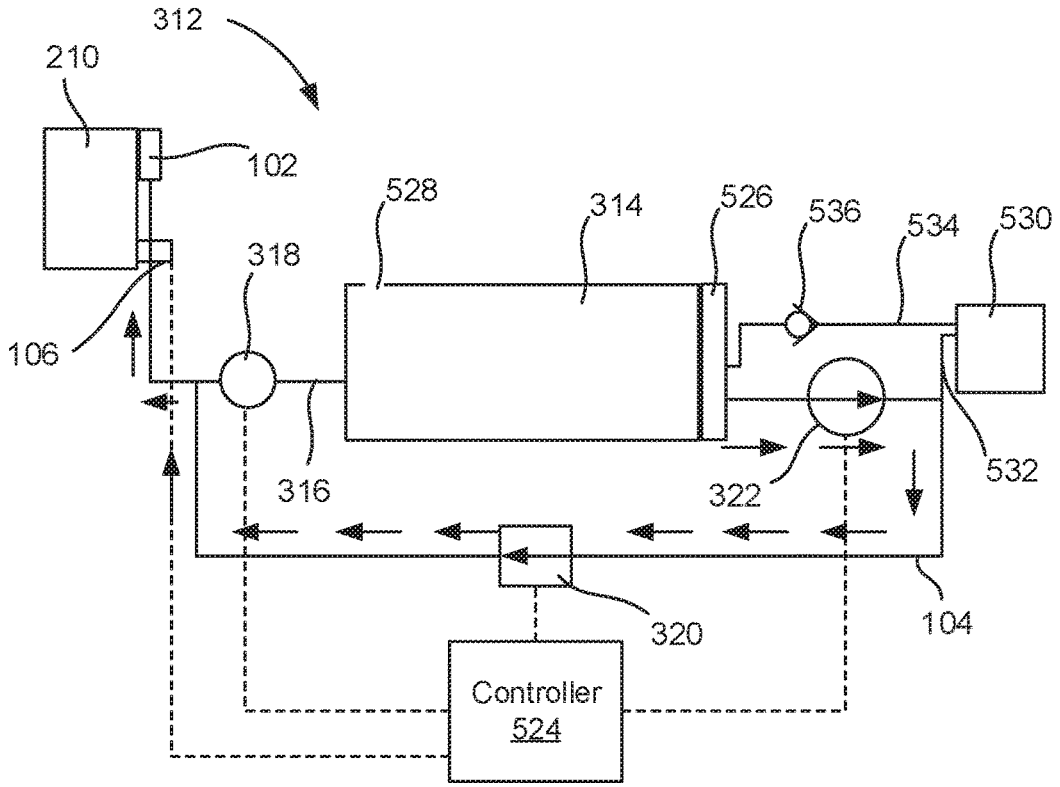
FIGS. 5A and 5B are diagrams of a fluid transport system for extraction reservoir-triggered fluid extraction, according to another example of the principles described herein.
Figure 5B:
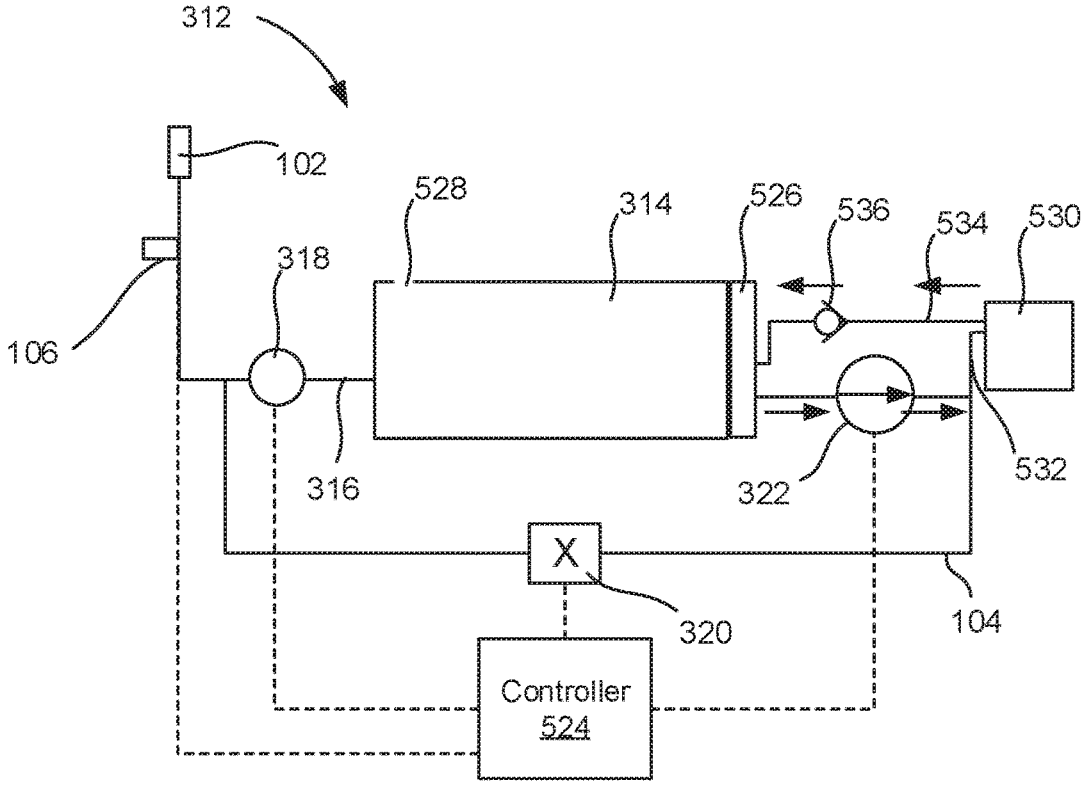

FIGS. 5A and 5B are diagrams of a fluid transport system (312) for extraction reservoir-triggered fluid extraction, according to another example of the principles described herein. Specifically, FIG. 5A is a diagram of the fluid transport system (312) during fluid extraction and FIG. 5B is a diagram of the fluid transport system (312) following removal of the removable extraction reservoir (210), for example during a printing operation. FIGS. 5A and 5B depict certain components depicted in FIGS. 3A and 3B such as the supply line (316), fill pump (318), reservoir (314), recirculation pump (322), return line (104), return line valve (320), interface (102), and switch (106).

FIGS. 5A and 5B also depict other components. For example, in this case, the fluid transport system (312) includes a controller (524) that controls operation of certain components. In this example, rather than the switch (106) being coupled directly to the return line valve (320), the switch (106) is coupled to the controller (524) which opens and closes the return line. The controller (524) also controls other components of the fluid transport system (312) such as the recirculation pump (322) and the fill pump (318). The control of these components may or may not be responsive to the toggling of the switch (106).

FIGS. 5A and 5B also depict a fluid level sensor (526) and a vent assembly (528). The fluid level sensor (526) is disposed on, or in, the reservoir (314) and defines when to terminate a fluid delivery operation. That is, the fluid level sensor (526) may indicate when the reservoir (314) is full, such that a reservoir (314) fill operation may be terminated. In another example, the fluid level sensor (526) may indicate when the reservoir (314) is empty, such that a fluid extraction operation may be terminated.

In some examples, the reservoir (314) includes a vent assembly (528), and may include more. During printing, the vent assembly (528) allows air to enter to prevent the formation of a vacuum. The vent assembly (528) also allows air to exit during refill to prevent over-pressuring the reservoir (314). The vent assemblies (528) may also be used to allow pressure relief when the reservoir (314) has been over-pressured.

FIGS. 5A and 5B also depict the printhead (530) from which fluid is ejected. That is, the printhead (530) may include various ejecting components that include chambers where a small amount of fluid is held. The controller (524) or another controller then activates at particular times to eject fluid from the chambers through an opening in a desired pattern. In this fashion, fluid is deposited on a substrate in a desired pattern in 2D printing, 3D printing, or another ejection operation.

FIGS. 5A and 5B also depict a pressure control device (536) disposed along a printhead return line (534). The pressure control device (536) ensures a desirable pressure differential in the printhead (530) during fluid deposition.

As depicted in FIGS. 5A and 5B, the return line (104) is coupled to the printhead line (532) that delivers fluid from the reservoir (314) to the printhead (530). During extraction, fluid is prevented from traveling through the printhead line (532) and the printhead return line (534) due to the fluid mechanics of those lines. That is, the printhead return line (534) may maintain a pressure that is greater than the pressure through the return line (104). Thus, the return line (104) presents a fluidic path with less fluidic resistance. Thus, during a fluid extraction process, fluid flows through the return line (104).

A description of the various states of the fluid transport system (FIG. 1, 100) will now be presented. Specifically, in FIG. 5A, the removable extraction reservoir (210) is inserted into the interface (102) of the printing device (FIG. 2, 208). Accordingly, the switch (106) is engaged. This engagement triggers the controller (524) to open the return line valve (320). This engagement may also trigger the activation of the recirculation pump (322), or the recirculation pump (322) may be triggered by a different mechanism. With both of these components active, the fluid passes through the return line (104) to the removable extraction reservoir (210) by way of a portion of the supply line (316). Due to the effect of the fill pump (318) being off, and thereby closed, fluid does not re-flow towards the reservoir (314) but instead is entirely directed to the removable extraction reservoir (210). Due to the effect of the high pressure printhead return line (534) and the pressure control device (536) fluid does not flow towards the printhead (530), but instead is directed through the return line (104).

FIG. 5B depicts the fluid transport system (312) in a state when the removable extraction reservoir (210) has been removed. Specifically, FIG. 5B depicts the fluid transport system (312) during a printing operation. Immediately upon removal, the switch (106) is disengaged. In this example, the controller (524) shuts the return line valve (320) so that fluid does not flow therethrough regardless of the activation state of the recirculation pump (322). Thus, the present fluid transport system (312) with the fluid extraction system (FIG. 1, 100) disposed therein, provides a mechanism to extract fluid from a reservoir (314) all while preventing unintentional and undesirable spillage of the fluid. In this example, even though the removable extraction reservoir (FIG. 2, 210) has been removed, the recirculation pump (322) remains active to deliver the fluid through to the printhead (530).

Figure 6A:
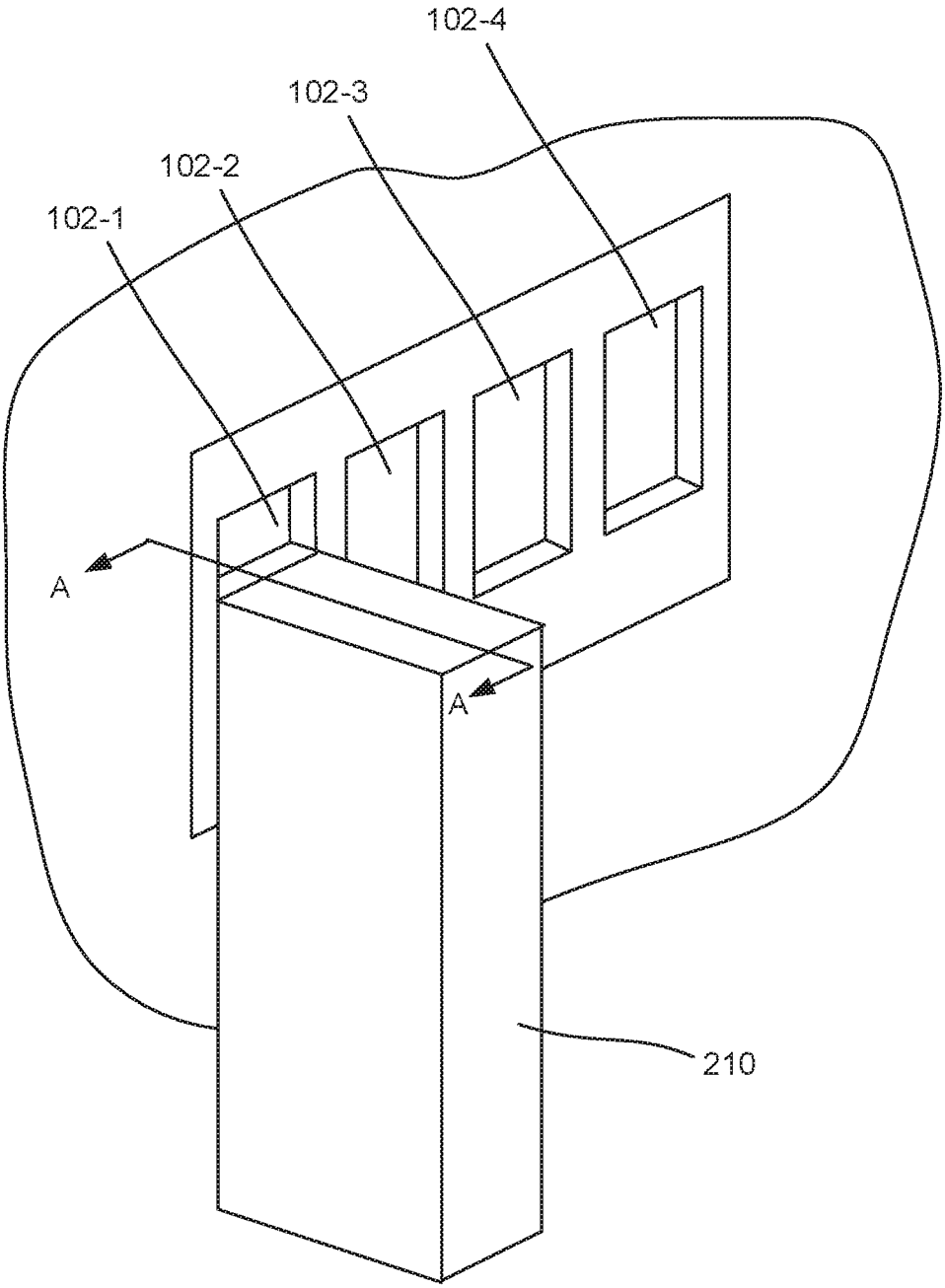
FIGS. 6A-6C are diagrams of a switch of the fluid extraction system, according to an example of the principles described herein.
Figure 6B:
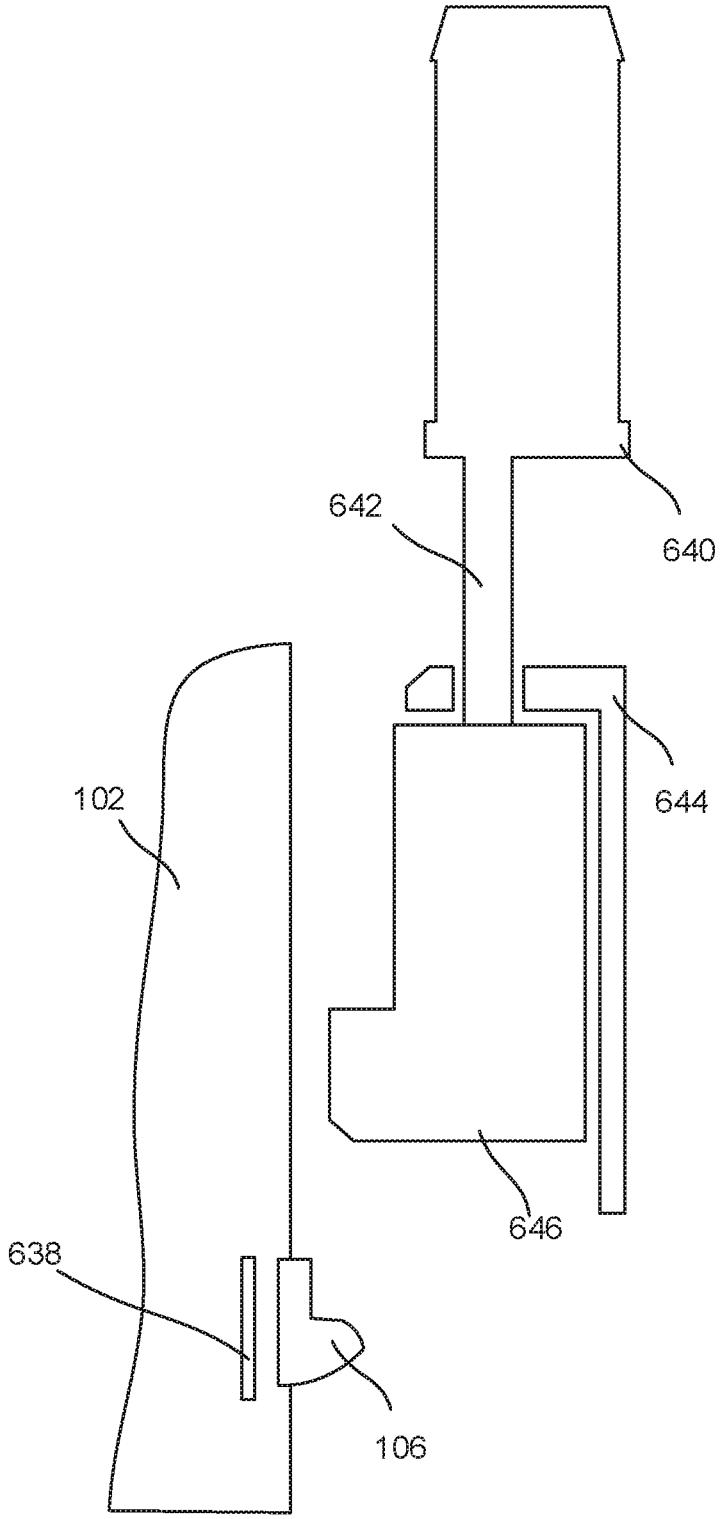
Figure 6C:
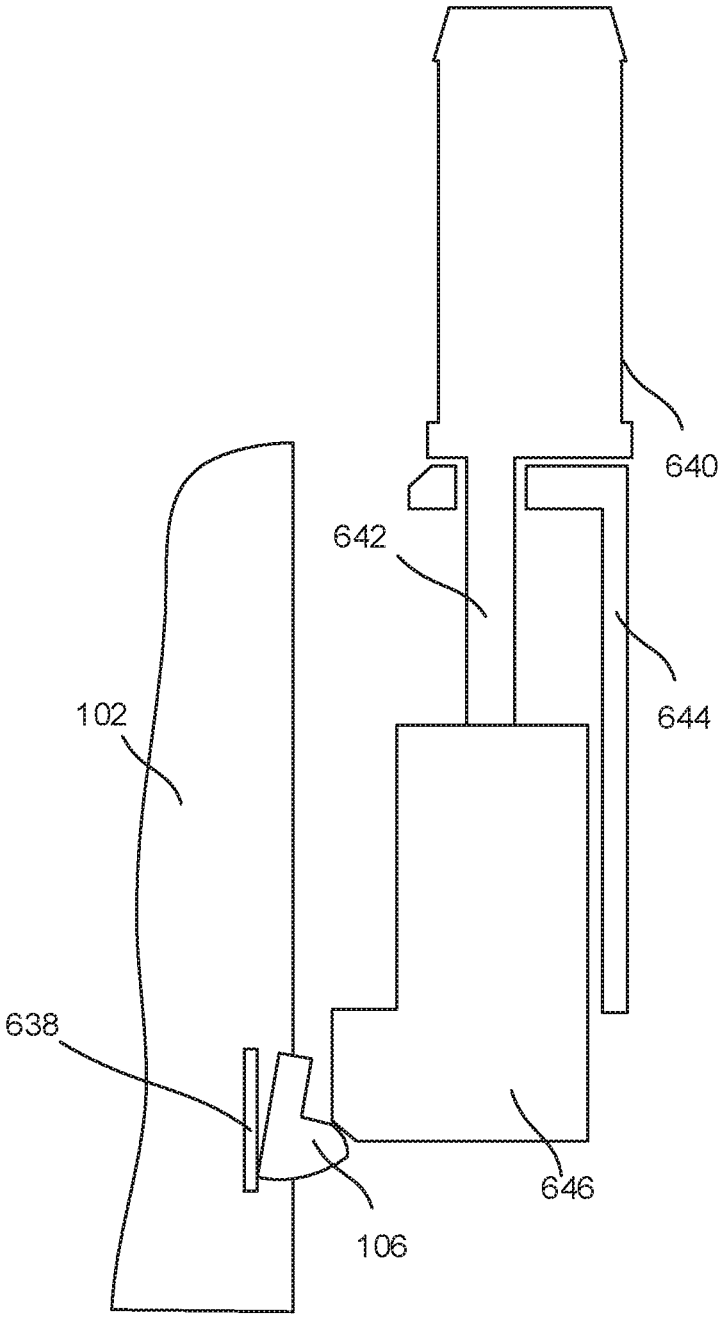

FIGS. 6A-6C are diagrams of a switch (FIG. 1, 106) of the fluid extraction system (FIG. 1, 100), according to an example of the principles described herein. Specifically, FIG. 6A depicts a removable extraction reservoir (210) disposed in an interface (102) of the printing device (FIG. 2, 208). As depicted in FIG. 6A, a printing device (FIG. 2, 208) may include multiple interfaces (102-1, 102-2, 102-3, 102-4), each to receive a different refill or removable extraction reservoir (210). For example, each interface (102) may correspond to a different color.

FIGS. 6B and 6C are cross-sectional diagrams taken along the line A-A in FIG. 6A. Specifically, FIG. 6B depicts a cross-sectional diagram before the switch (106) is engaged and FIG. 6C depicts a cross-sectional diagram after the switch (106) is engaged. FIG. 6B depicts a protrusion (640) that may be formed on a part of the removable extraction reservoir (FIG. 2, 210) that is inserted into the interface (102). It is this protrusion (640) that toggles the switch (106). Note that when a removable extraction reservoir (FIG. 2, 210) is not inserted as depicted in FIG. 6B, the switch (106) is biased away from a contact surface (638) such as a printed circuit board. Contact with the contact surface (638) within the interface (102) may facilitate opening of the return line valve (FIG. 3, 320).

In some examples, the removable extraction reservoir (FIG. 2, 210) is uniquely paired with a particular interface (102). That is, the protrusion (640) may include a key (642) with a size and shape to match a key slot (644) in the interface (102). Accordingly, if the key (642) size and shape match the key slot (644), the key (642) passes through and contacts a plunger (646) in the interface (102). Accordingly, during insertion, a user continues to push on the removable extraction reservoir (FIG. 2, 210) until the plunger (646) interfaces with the switch (106) as depicted in FIG. 6C.

Note that as the plunger (646) contacts the switch (106), the switch (106) is pivotally coupled to the interface (102) such that it swings. In so doing, the switch (106) contacts the contact surface (638) thus establishing an electrical connection between either 1) a power source and the return line valve (FIG. 3, 320) or 2) that sends a trigger signal to the controller (FIG. 5, 524) to instruct the controller (FIG. 5, 524) to open/close the return line valve (FIG. 3, 320) and/or the recirculation pump (FIG. 3, 322).

Figure 7:
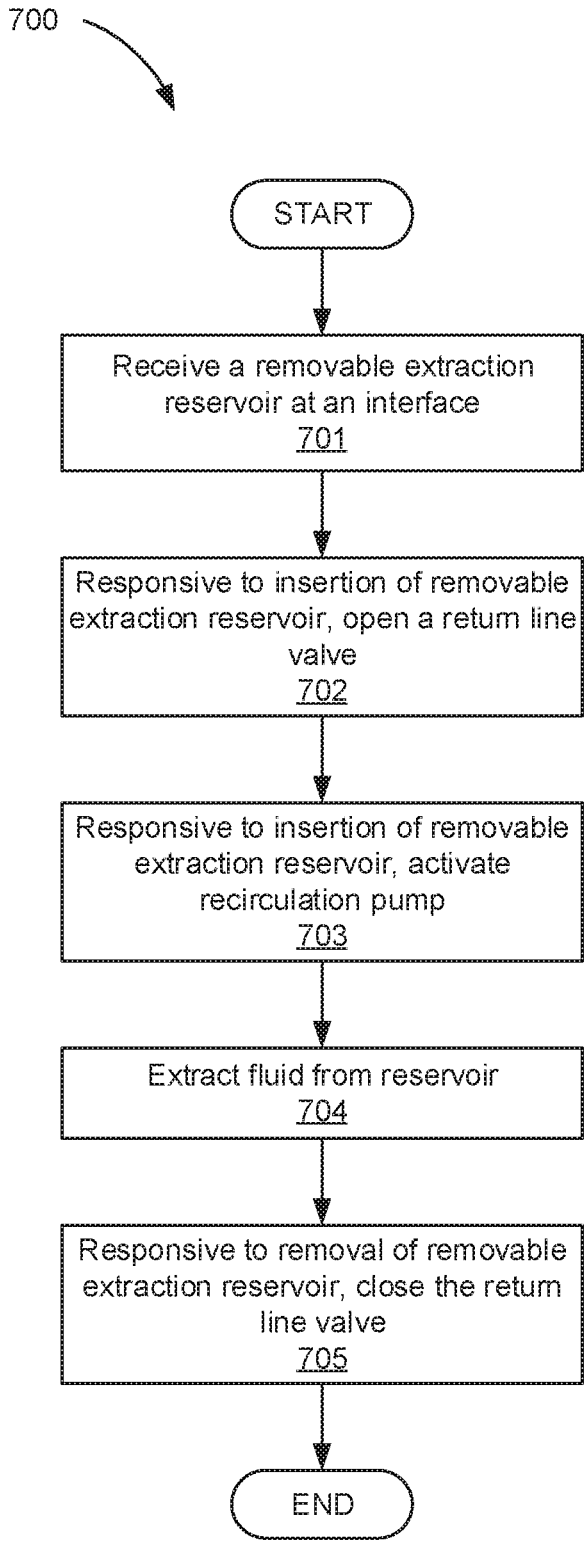
FIG. 7 is a flowchart of a method for extracting fluid to a removable extraction reservoir, according to an example of the principles described herein.

FIG. 7 is a flowchart of a method (700) for extracting fluid to a removable extraction reservoir (FIG. 2, 210), according to an example of the principles described herein. According to the method (700), a removable extraction reservoir (FIG. 2, 210) is received (block 701) at an interface (FIG. 1, 102). Responsive to the insertion, a return line valve (FIG. 3, 320) is opened (block 702) such that fluid may readily flow through the return line (FIG. 1, 104) into the removable extraction reservoir (FIG. 2,2 10). In some examples, this may be performed as described above in connection with FIG. 4.

In some examples, in addition to triggering an opening of the return line valve (FIG. 3, 320), activation of the switch (FIG. 1, 106) via the insertion of the removable extraction reservoir (FIG. 2, 210) may activate (block 703) the recirculation pump (FIG. 3, 322) such that fluid is drawn from the reservoir (FIG. 3, 314) to the removable extraction reservoir (FIG. 2, 210). Fluid is then extracted (block 704) from the reservoir (FIG. 3, 314) as described above in connection with FIG. 4.

In addition to taking certain actions upon insertion of the removable extraction reservoir (FIG. 2, 210), certain actions may be triggered by removal of the removable extraction reservoir (FIG. 2, 210). For example, responsive to removal of the removable extraction reservoir (FIG. 2, 210), the return line valve (FIG. 3, 320) may be closed (block 705). That is, upon removal, the removable extraction reservoir (FIG. 2, 210) no longer interfaces with the switch (FIG. 1, 106), such that the switch (FIG. 1, 106) returns to it's biased, or open position. A sensor may detect that the switch (FIG. 1, 106) is in this biased open position. For example, the switch (FIG. 1, 106) in its open position may result in a broken circuit. Accordingly, the return line valve (FIG. 3, 320) may be closed responsive to this action. Moreover, in some examples, in addition to closing the return line valve (FIG. 3, 320) responsive to the disengagement of the switch (FIG. 1, 106), such an action may deactivate the recirculation pump (FIG. 3, 322) such that fluid is no longer drawn through the return line (FIG. 1, 104). In yet another example, the recirculation pump (FIG. 3, 322) is not responsive to the triggering of the switch and rather is deactivated by another controller independent of the removal of the removable extraction reservoir (FIG. 2, 210).

Such a fluid extraction system may 1) prevent disposal of otherwise usable fluid disposed within an out-of-contract/non-functioning printing device; 2) reduce financial exposure for fluid suppliers as they can reclaim fluid dispensed in an out-of-contract/non-functioning printing device; 3) prevent printing device failure due to ink drying out during long term storage; 4) reduce service cost and complexity; 5) prevent re-fill with unauthorized fluid; 6) allow printing device recyclability without fluid in reservoir; 7) enable extraction from a single reservoir; 8) enable secure reclamation and refilling of ink; and 9) prevents fluid spillage during/after fluid extraction due to removal of a removable extraction reservoir.

What is claimed is:

1. A fluid extraction system comprising:
- an interface to fluidically and electrically couple a removable extraction reservoir to a printing device;
- a return line to connect the interface and a reservoir of the printing device; and
- a switch to:
  - responsive to attachment of the removable extraction reservoir to the printing device, open the return line to direct fluid form the reservoir to the interface; and
  - responsive to removal of the removable extraction reservoir from the printing device, close the return line.

2. The fluid extraction system of claim 1, further comprising a return line valve to:
- open responsive to an insertion of the removable extraction reservoir; and
- close responsive to a removal of the removable extraction reservoir.

3. The fluid extraction system of claim 1, wherein the switch is to send a signal to a controller to open and close the return line.

4. The fluid extraction system of claim 1, wherein the switch is to directly control the opening and closing of the return line.

5. The fluid extraction system of claim 1, further comprising a recirculation pump to, responsive to the attachment of the removable extraction reservoir, activate to draw fluid through the return line.

6. The fluid extraction system of claim 1, wherein the recirculation pump, responsive to a removal of the removable extraction reservoir, is to deactivate.

7. The fluid extraction system of claim 1 further comprising a supply line to transport fluid from the removable extraction reservoir to the reservoir.

8. The fluid extraction system of claim 7, wherein the return line is coupled to the supply line between the interface and a fill pump.

9. A fluid transport system comprising:
- a reservoir to hold an amount of fluid;
- an interface to fluidically couple a removable extraction reservoir to a printing device;
- a supply line to connect the interface and the reservoir;
- a fill pump to draw fluid to the reservoir;
- a return line to connect the reservoir and the supply line, wherein the return line is coupled to the supply line between the interface and fill pump;
- a return line valve disposed along the return line to open and close the return line;
- a switch disposed in the interface to:
  - responsive to attachment of the removable extraction reservoir to the printing device, open the return line valve to direct fluid from the reservoir to the removable extraction reservoir; and
  - responsive to removal of the removable extraction reservoir from the printing device, close the return line valve; and
- a recirculation pump to, during an extraction operation, move fluid from the reservoir to the interface.

10. The fluid transport system of claim 9, further comprising:
- a fluid level sensor disposed in the reservoir;
- a vent assembly disposed on the reservoir;

a pressure control device disposed along a printhead return line; or combinations thereof.

11. The fluid transport system of claim 9, wherein the return line is coupled to a printhead line that delivers fluid to a printhead.

12. The fluid transport system of claim 11, further comprising a printhead return line that delivers fluid from the printhead to the reservoir.

13. A method comprising:

receiving, at an interface of a printing device, a removable extraction reservoir;

responsive to attachment of the removable extraction reservoir, opening a return line valve to fluidically couple a return line to the removable extraction reservoir; and extracting fluid from the reservoir to the removable extraction reservoir.

14. The method of claim 13, further comprising, responsive to removal of the removable extraction reservoir, closing the return line valve to prevent fluid from flowing towards the interface.

15. The method of claim 13, further comprising:

responsive to insertion of the removable extraction reservoir, activating a recirculation pump to draw fluid through the return line; and responsive to removal of the removable extraction reservoir, deactivating the recirculation pump.

* * * * *